US005779972A

United States Patent [19]

Noda et al.

[11] Patent Number: 5,779,972

[45] Date of Patent: Jul. 14, 1998

[54] HEAT RESISTING ALLOYS, EXHAUST VALVES AND KNIT MESHES FOR CATALYZER FOR EXHAUST GAS

[75] Inventors: Toshiharu Noda, Tajimi; Michio Okabe, Chita; Katsuaki Sato; Tsutomu Saka, both of Wako, all of Japan

[73] Assignees: Daido Tokushuko Kabushiki Kaisha, Nagoya; Honda Giken Kogyo Kabushiki Kaisha, Tokyo, both of Japan

[21] Appl. No.: 832,675

[22] Filed: Apr. 9, 1997

[30] Foreign Application Priority Data

Apr. 12, 1996 [JP] Japan ..... 8-091270

[51] Int. Cl.[6] ..... C22C 38/48

[52] U.S. Cl. ..... 420/54; 420/584.1

[58] Field of Search ..... 420/54, 584.1

[56] References Cited

U.S. PATENT DOCUMENTS 5,567,383 10/1996 Noda et al. ..... 420/584.1

FOREIGN PATENT DOCUMENTS 56-81661 7/1981 Japan ..... 420/584.1
58-185741 10/1983 Japan .
60-13050 1/1985 Japan ..... 420/584.1
60-46343 3/1985 Japan .

*Primary Examiner*—Deborah Yee
*Attorney, Agent, or Firm*—Sughrue, Mion, Zinn, Macpeak & Seas, PLLC

[57] ABSTRACT

A heat resisting alloy of Fe—Cr—Ni type for exhaust valves, knit meshes for the catalyzer and the like which is low in price and excellent in high temperature properties, which consists essentially by weight percentage of C:0.01~0.10%, S:≦2.0%, Mn ≦2.0%, Cr:14~18%, Nb+Ta:0.5~1.5%, Ti:2.0~3.0%, Al:0.8~1.5%, Ni:30~35%, B:0.001~0.01%, Ca+Mg:0.001~0.01%,Cu≦0.5%, P≦0.02%, S≦0.01%, O≦0.01%, N≦0.01%, and the balance of Fe, additionally the total atomic percentage of Al, Ti, Nb and Ta:5.0~7.0%, and atomic percentage ratio of Ti/Al:1.0~1.5, and M-value calculated from the following equation ≦0.95;

$$M=[0.717\ Ni(at.\%)+0.858\ Fe(at.\%)+1.142\ Cr(at.\%)+1.90\ Al(at.\%)+2.271\ Ti(at.\%)+2.117\ Nb(at.\%)+2.224\ Ta(at.\%)+1.001\ Mn(at.\%)+1.90\ Si(at.\%)]/100.$$

18 Claims, No Drawings

HEAT RESISTING ALLOYS, EXHAUST VALVES AND KNIT MESHES FOR CATALYZER FOR EXHAUST GAS

BACKGROUND OF THE INVENTION

1. Field of the Invention

This invention relates to a heat resisting alloy of Fe—Cr—Ni type which is excellent in the high-temperature strength and not so expensive, an exhaust valve for an automotive engine and a knit mesh for a catalyzer purifying exhaust gas of the automotive engine which are manufactured by using the aforementioned heat resisting alloy.

2. Description of the Prior Art

Hitherto, as a material for an exhaust valve of gasoline engines, high Mn austenitic heat resisting steel JIS SUH 35 (Fe-9Mn-21Cr-4Ni-0.5C-0.4N) has been widely used, and as a material for a high-strength exhaust valve for high power engine used at 800° C. or above, Ni-based super alloy JIS NCF 751 (Ni-15.5Cr-0.9Nb-1.2Al-2.3Ti-7Fe-0.05C) has been used. The Ni-based super alloy is an alloy excellent not only in the high-temperature strength but also in the high-temperature oxidation resistance and the high-temperature corrosion resistance. Namely, although there is a problem in that the valve undergoes high-temperature corrosion by PbO and $PbSO_4$ produced on a surface of the valve as combustion products in a case of using leaded gasoline which is added with tetraethyl lead in order to increase the octane value, the high-temperature corrosion resistance is improved in this super alloy NCF751 by increasing the amount of Ni up to 70%. However, this super alloy contains Ni as much as 70% and there is a problem in the cost. Therefore, an alloy containing Ni reduced down to 60% in order to cut the price and yet having the property equal to that of the super alloy NCF751 has been developed and applied not only to the exhaust valve of the engine, but also to a knit mesh for a catalyzer purifying exhaust gas which is exposed to a high-temperature atmosphere similarly to the exhaust valve of the engine (cf. Japanese Patent Application No. 63-95731/88, for example).

Lately, removal or reduction of tetraethyl lead from leaded gasoline is forwarded and the problem concerning the high-temperature corrosion becomes not so severe as compared with before, and it becomes clear that alloys are available sufficiently for the exhaust valve of the engine and the knit mesh of catalyzer for purifying exhaust gas even if the high-temperature corrosion resistance is degraded in some degree by reducing Ni content in alloys. Therefore 40% Ni alloy containing further reduced Ni content is proposed recently for the purpose of cutting the price (cf. Japanese Patent Application No. 6-133050/94, for example).

However, a demand for development of the heat resisting material which is further low in price and further excellent in the high-temperature strength is increasing rapidly in the economic situation as it is. Furthermore, it is also required that deterioration is not appeared in the properties even after use for a long time at a high-temperature from the viewpoint of improving reliability of the automobile. As approaches for cheapening the material alloy, there are a method to study chemical compositions of the alloy and another method to investigate a production process of the alloy. In the former method, it is considered to reduce the amount of expensive Ni and to increase the amount of inexpensive Fe. Although alloys containing Ni of not higher than 40% have been already developed (cf. Japanese Patent Application No. 54-93719/79 and No. 59-130628/84, for example), there is a problem in such the alloys in that η-phase ($Ni_3Ti$) which is an embrittlement phase is precipitated by the application at a high-temperature for a long time, thereby reducing the high-temperature strength and the toughness at a room temperature because the increase of Fe deteriorates stability of the structure at a high-temperature.

SUMMARY OF THE INVENTION

This invention is made in view of the aforementioned problem of the prior art, and it is an object to develop a heat resisting alloy of Fe—Cr—Ni type which is further cheapened by reducing Ni content down to a low level of 30 to 35%, excellent in the high-temperature strength at 800° C. and the hot workability, and has an excellent structural stability such that harmful η-phase and σ-phase are not precipitated by the long time application, and sufficient oxidation resistance, and it is another object to provide an exhaust valve for the automotive engine and a knit mesh for a catalyzer purifying exhaust gas of the automotive engine which are economical and have excellent properties.

That is, the heat resisting alloy of Fe—Cr—Ni type according to this invention for accomplishing the aforementioned objects is characterized by consisting by weight percentage of 0.01 to 0.10% of C, not more than 2% of Si, not more than 2% of Mn, 14 to 18% of Cr, 0.5 to 1.5% in total of Nb and Ta, 2.0 to 3.0% of Ti, 0.8 to 1.5% of Al, 30 to 35% of Ni, 0.001 to 0.01% of B, 0.001 to 0.01% in total of Ca and Mg, not more than 0.5% of Cu, not more than 0.02% of P, not more than 0.01% of S, not more than 0.01% of O, not more than 0.01% of N, optionally not more than 0.5% in total of W and Mo, and not more than 5.0% of Co with the proviso that the total of Ni and Co is in the range of 30 to 35%, and the balance being Fe and inevitable impurities, wherein the total atomic percentage of Al, Ti, Nb and Ta is in a range of 5.0 to 7.0%, an atomic percentage ratio of Ti/Al is in a range of 1.0 to 1.5, and M-value calculated using the following equation does not exceed 0.95;

$$M=(0.717\ Ni(\text{atomic percentage})+0.858\ Fe(\text{atomic percentage})+1.142\ Cr(\text{atomic percentage})+1.90\ Al(\text{atomic percentage})+2.271\ Ti(\text{atomic percentage})+2.117\ Nb(\text{atomic percentage})+2.224\ Ta(\text{atomic percentage})+1.001\ Mn(\text{atomic percentage})+1.90\ Si(\text{atomic percentage}))/100.$$

The heat resisting alloy according to a preferred embodiment of this invention is characterized in that the high-temperature hardness at 800° C. is not lower than 200 of Vickers hardness.

The heat resisting alloy according to another preferred embodiment of this invention is characterized in that the 2 mm U-notch charpy impact valve at a room temperature after heating at 800° C. for 400 hours is not lower than 50 $J/cm^2$.

The heat resisting alloy according to the other preferred embodiment of this invention is characterized in that the high-temperature rotary bending fatigue strength of $10^8$ times at 800° C. after heating at 800° C. for 400 hours is not lower than 147 MPa.

The exhaust valve for the automotive engine according to another aspect of this invention is characterized by being made of the heat resisting alloy of Fe—Cr—Ni type according to this invention.

The knit mesh for a catalyzer purifying exhaust gas of the automotive engine according to the other aspect of this invention is characterized by being made of the heat resisting alloy of Fe—Cr—Ni type according to this invention.

DETAILED DESCRIPTION OF THE INVENTION

In the heat resisting alloy of Fe—Cr—Ni type according to the invention, the reason why the chemical compositions of the alloy is limited to the above-memtioned ranges will be described below.

C:0.01 to 0.10 wt %

C forms carbides by combining with Ti, Nb or Cr and improves the high-temperature strength of the alloy. It is necessary to add C in an amount of at least 0.01% in order to obtain such the effect. However, when C is added excessively, MC type-carbides are much precipitated, whereby flaws appear on a surface from the carbides at the time of cold drawing or rolling of alloy in addition to the deterioration of the hot workability of the alloy. Therefore, the upper limit of C is defined as 0.10%.

Si:not more than 2 wt %

Si is added not only as a deoxidation element but also as an element effective for improving the oxidation resistance. However, excessive addition of Si causes deterioration of the ductility of the alloy, so that upper limit of Si is defined as 2%.

Mn:not more than 2 wt %

Mn is added to the alloy as a deoxidation element similarly to Si, but the high-temperature oxidation resistance is deteriorated and precipitation of η-phase ($Ni_3Ti$) harmful to the ductility of the alloy is promoted when Mn is added in large quantities. Therefore, the upper limit of Mn is defined as 2%.

Cr:14 to 18 wt %

Cr is an element effective to improve the high-temperature oxidation resistance and the corrosion resistance. It is necessary to add Cr in an amount of not less than 14% in order to maintain the sufficient high-temperature oxidation resistance and corrosion resistance at a high temperature as high as 850° C., however the austenite phase becomes unstable, the γ-phase (brittle phase) is precipitated, and the ductility of the alloy is degraded when Cr is added in an amount of more than 18%. Accordingly, the upper limit of Cr is defined as 18%.

Nb+Ta:0.5 to 1.5 wt %

Nb and Ta are elements for forming γ'-phase {$Ni_3$ (Al, Ti, Nb, Ta) } which is a precipitation hardening phase in the Ni-based super alloy, and effective not only for reinforcing the γ'-phase but also for preventing coarsening of the γ'-phase. It is necessary to add Nb and Ta in the total amount of at least 0.5% in order to obtain the above-mentioned effects. However, δ-phase {$Ni_3$ (Nb, Ta) } is precipitated and the ductility of the alloy is lowered when Nb and Ta are added excessively. Accordingly, the upper limit of the total amount of Nb and Ta is defined 1.5%. It is preferable to define the total amount of Nb and Ta in a range of 0.6 to 1.0%.

Ti:2.0 to 3.0 wt %

Ti is an element for combining with Ni together with Al, Nb and Ta to form the γ'-phase and strengthening the γ'-phase. Age-precipitation hardening of the γ'-phase is activated by adding Ti. It is necessary to add Ti in an amount of 2.0% at the lowest in order to obtain such the effects. However, the excessive addition of Ti brings about the precipitation of the η-phase (enbrittlement phase) to deteriorate the ductility of the alloy. Therefore, the upper limit of Ti content is defined as 3.0%. It is preferable to define the Ti content in a range of 2.4 to 2.8%.

Al:0.8 to 1.5 wt %

Al is the most important element which combines with Ni to form the γ'-phase. It is necessary to add Al in an amount of at least 0.8% since the γ'-phase is not precipitated sufficiently, the γ'-phase becomes unstable and the η-phase or the δ-phase is precipitated to cause the embrittlement if Ti, Nb and Ta exist in the alloy in large quantities in a case where Al content is too low. However, the upper limit of the Al content is defined as 1.5% because the hot workability of the alloy is degraded and forming into valves or wires becomes impossible when the amount of Al is too large. It is preferable to define the Al content in a range of 0.9 to 1.3%.

Ni:30 to 35%

Ni is an element forming the austenite that is a matrix of the alloy and an element effective to improve the heat resistance and the corrosion resistance of the alloy. Furthermore, Ni is an element for forming the γ'-phase which is a precipitation reinforcement phase. It is necessary to add Ni of not less than 30% in order to sufficiently form the γ'-phase at an objective temperature of 800° C. However, Ni is a very expensive element, so that the addition of Ni in large quantities raises the cost of the alloy and is unfit for the purpose of this invention. Accordingly, the upper limit of Ni is defined as 35%.

Co:not more than 5.0 wt %

Co is soluble in the austenite matrix and, activates the solution of the γ'-phase and improves the workability of the alloy in a temperature range of hot working. Furthermore, Co increases a precipitation amount of the γ'-phase and improves the high-temperature strength of the alloy in a practical application temperature range. Therefore, Co may be added by replacing Ni according to demand within a range of 30 to 35% in total of Ni and Co. However, Co is a further expensive element as compared with Ni and it is suitable to define the upper limit of Co to 5.0%.

B:0.001 to 0.01 wt %

B is an element effective for improving the hot workability in addition to improving to creep rupture strength by precipitating at the grain boundary, and it is necessary to add B in an amount of not less than 0.001% in order to sufficiently develop such the effects. However, excessive addition of B is harmful to the hot workability of the alloy, therefore the upper limit of B is defined as 0.01%.

Ca+Mg:0.001 to 0.01 wt %

There are elements to be added as deoxidation and desulfurizing element at the time of melting the alloy, and effective to improve the hot workability of the alloy. The aforementioned effects of Ca and Mg are obtained when Ca and Mg are added in an amount of not less than 0.001% respectively. However, excessive addition of Ca and Mg deteriorates the hot workability, so that the upper limit of the total amount of Ca and Mg is defined as 0.01%.

W+Mo:not more than 0.5 wt %

Although W and Mo are soluble in the matrix and elements effective to improve the high-temperature strength of the alloy according to solution reinforecement, these elements are expensive and not so effective as compared with the precipitation hardening caused by the precipitation of the γ'-phase. Furthermore, stability of the matrix phase is sometimes harmed when Mo and W are added in large quantities. Accordingly, W and Mo are not always elements to be added positively in view of the purpose of this invention. However, considering from a viewpoint of reduction of the cost, it is desirable to reuse scraps containing Mo and W as raw materials. Therefore, in the heat resisting alloy according to this invention, Mo and W are allowable in a range of not more than 0.5% in total so as not to harm the phase stability of the matrix.

Cu:not more than 0.5 wt %

P:not more than 0.02 wt %

S:not more than 0.01 wt %

O:not more than 0.01 wt %

N:not more than 0.01 wt %

Cu, P and S are elements harmful to the hot workability of the alloy. O and N are also harmful elements which form non-metallic inclusions composed of oxides and nitrides and deteriorate the mechanical properties of the alloy. Therefore, Cu, P, S, O and N are controlled as acceptability limits in this invention in respective amounts of not more than 0.5% of Cu, not more than 0.02% of P, not more than 0.01% of S, O and N.

Fe:balance

Fe being the balance of alloy is an element forming the austenite phase, which is the matrix.

Total atomic percentage of Al, Ti,Nb and Ta:5.0 to 7.0%

All of Al, Ti, Nb and Ta are elements forming the γ'-phase. The precipitation amount of the γ'-phase is proportional to the total atomic percentage of these elements in a case the sufficient amount of Ni exists in the alloy. Since the high-temperature strength of the alloy is proportional to the precipitation amount of the γ'-phase, the high-temperature strength is improved in proportion to the total atomic percentage of these elements. A soluble temperature of the γ'-phase at a high temperature is lowered with decrease of the Ni content, that is, the precipitation amount of the γ'-phase is decreased and the high-temperature strength of the alloy is lowered according to the decrease of the Ni content even when the total atomic percentage of Al, Ti, Nb and Ta is unchanged. Accordingly, it is necessary to add these elements in an amount of not less than 5% in the total atomic percentage of Al, Ti, Nb and Ta in order to obtain the sufficient strength at the temperature of 800° C. in the heat resisting alloy according to this invention which contains Ni in the range of 30 to 35%. However, if the total atomic percentage of these elements exceeds 7.0%, the strength is improved but the hot workability of the alloy is deteriorated and the alloy becomes unfit for the purpose of this invention, therefore the upper limit of the total atomic percentage of Al, Ti, Nb and Ta is defined as 7.0%. It is preferable to define the total atomic percentage of these elements in a range of 5.5 to 6.6%.

Atomic percentage ratio of Ti/Al:1.0 to 1.5

The η-phase ($Ni_3Ti$), that is an intermetallic compound precipitated during the application for a long time, deteriorates the mechanical properties of the alloy. The precipitation of the η-phase depends on the Fe content and the ratio of atomic percentage of Ti to Al (Ti/Al) in the alloy. Accordingly, the atomic percentage ratio of Ti/ Al is controlled so as not to precipitate the η-phase in this invention. Namely, the higher the Fe content by reducing the Ni content, and the higher the atomic percentage ratio of Ti/Al, the more remarkable the tendency to cause the precipitation of the η-phase. The η-phrase is precipitated when the ratio of Ti/Al becomes higher than 1.5 by atomic percentage in the heat resisting alloy according to this invention which contains Ni in the range of 30 to 35%. Therefore, the atomic percentage ratio of Ti/Al is limited to not higher than 1.5 in the heat resisting alloy according to this invention. Furthermore, when the ratio of Ti/Al is lower than 1.0 by atomic percentage, the age-hardening rate becomes slow and it becomes difficult to obtain the sufficient strength by aging in a short time, therefore the atomic percentage ratio of Ti/Al is limited to not lower than 1.0.

M-value:not exceeding 0.95

$$M=\{0.717\ Ni(\text{atomic percentage})+0.858\ Fe(\text{atomic percentage})+1.142\ Cr(\text{atomic percentage})+1.90\ Al(\text{atomic percentage})+2.271\ Ti(\text{atomic percentage})+2.117\ Nb(\text{atomic percentage})+2.224\ Ta(\text{atomic percentage})+1.001\ Mn(\text{atomic percentage})+1.90\ Si(\text{atomic percentage})\}/100$$

The σ-phase, that is an intermetallic compound precipitated during the application at a high temperature for a long time, deteriorates the mechanical properties of the alloy. With reference to the σ-phase, it has been made clear according to this investigation that the σ-phase is precipitated when the M-value calculated using the aforementioned equation becomes larger than 0.95 in the heat resisting alloy of this invention containing 30 to 35% of Ni. Furthermore, it has been also made clear that the M-value has concern with the hot workability of the alloy and the workability is degraded when the M-value becomes larger than 0.95. Accordingly, the M-Value is controlled so as not to exceed 0.95 in the heat resisting alloy according to this invention.

The aforementioned heat resisting alloy of Fe—Cr—Ni type according to this invention is refined through the special refinement such as electroslag remelting or vacuum arc remelting after being molten in the atmosphere or vacuum, and cast into ingots. The ingots is completed into primary products through the hot working such as hot forging and hot rolling.

The primary products are formed into heat resisting members such as engine valves or so, and received practical application after being subjected to solid solution treatment at 900°~1100° C., which is generally used for γ'-precipitation hardening alloys, and aging treatment at 600°~800° C. In a case where the hot working combined with the solid solution treatment is performed, the aging treatment may be carried out directly after the hot working.

Furthermore, the heat resisting alloy of Fe—Cr—Ni type according to this invention is formed into a wire by repeating cold or warm working and annealing after the solid solution treatment of the hot-rolled bar or wire rod of the alloy, and the wire is formed into a knit mesh for an exhaust gas treatment equipment.

In the valve material for the automotive engine, it is desirable that the hardness at 800° C. is higher than $H_v$ 200. Therefore, in the heat resisting alloy of Fe—Cr—Ni type according to the preferred embodiment, the hardness at 800° C. is defined as $H_v$ 200 or above.

In the valve material for the automotive engine of which 2 mm U-notch Charpy impact valve is lower than 50 J/cm$^2$ after aging at 800° C. for 400 hours, there is a fear of breakage of the valve in a case where the engine is suddenly operated at a high speed or so. Accordingly, in the heat resisting alloy of Fe—Cr—Ni type according to the other preferred embodiment of this invention, the 2 mm U-notch Charpy impact valve after aging at 800° C. for 400 hours is defined as 50 J/cm$^2$ or above.

Furthermore, in a member applied with repeated stress at a high temperature such as a valve for the automotive engine, fatigue is one of the largest factors decisive for lifetime of the member. In order to guarantee the lifetime of the valve, it is desirable to define high-temperature rotary bending fatigue strength of $10^8$ times at 800° C. after aging at 800° C. for 400 hours at 147 MPa or above. Therefore, in the heat resisting alloy of Fe—Cr—Ni type according to the other preferred embodiment of this invention, the aforementioned fatigue strength is satisfied through appropriate heat treatment.

EXAMPLE

Experiment 1

Alloys having chemical compositions shown in Table 1 were molten in a vacuum induction furnace, and then cast into ingots of 30 kg, respectively. Subsequently, round bar specimens of 8 mm in diameter were cut out from the lowermost part of respective ingots after soaking treatment at 1100° C. for 15 hours, and the high temperature-high speed tensile test was carried out using the round bar specimens.

The remaining ingots were subjected to forging and rolling at a temperature range of 1100° C. to 900° C. to form round bars of 16 mm in diameter, respectively. The obtained round bars were subjected to solid solution heat treatment (oil cooling after heating at 1050° C. for 30 minutes) and aging heat treatment (air-cooling after heating at 750° C. for 4 hours) in order to use them as short time aging testing materials. Furthermore, long time aging testing materials were prepared by cooling the round bars after heating at 1050° C. for 30 minutes, further heating successively at 800° C. for 400 hours and cooling in air in order to examine the mechanical properties after the long time heating. Each of test specimens for the hardness test, the impact test and the fatigue test was cut from respective testing materials and supplied to the respective tests.

TABLE 1

| Alloy No. | Chemical composition (wt %) | | | | | | | | | | |
|---|---|---|---|---|---|---|---|---|---|---|---|
| | C | Si | Mn | P | S | Cu | Ni | Co | Cr | Mo + W | Nb + Ta |
| Invention alloy | | | | | | | | | | | |
| 1 | 0.051 | 0.23 | 0.35 | 0.002 | 0.002 | 0.02 | 32.4 | — | 15.9 | — | 0.80 |
| 2 | 0.043 | 0.20 | 0.16 | 0.002 | 0.002 | 0.03 | 31.9 | — | 16.4 | — | 0.74 |
| 3 | 0.047 | 0.14 | 0.27 | 0.003 | 0.003 | 0.03 | 32.1 | — | 15.6 | — | 0.79 |
| 4 | 0.031 | 0.29 | 0.41 | 0.002 | 0.002 | 0.01 | 33.1 | — | 14.2 | — | 0.84 |
| 5 | 0.071 | 0.21 | 0.33 | 0.003 | 0.003 | 0.02 | 32.5 | — | 15.3 | — | 1.05 |
| 6 | 0.032 | 0.28 | 0.41 | 0.003 | 0.003 | 0.03 | 31.4 | — | 16.1 | — | 0.74 |
| 7 | 0.045 | 0.41 | 0.32 | 0.003 | 0.002 | 0.02 | 30.1 | — | 16.8 | — | 0.65 |
| 8 | 0.053 | 0.22 | 0.21 | 0.002 | 0.002 | 0.03 | 34.9 | — | 15.3 | — | 1.03 |
| 9 | 0.061 | 0.02 | 0.24 | 0.004 | 0.002 | 0.03 | 32.4 | — | 14.1 | — | 0.83 |
| 10 | 0.047 | 0.35 | 0.52 | 0.003 | 0.003 | 0.02 | 33.2 | — | 17.6 | — | 0.78 |
| 11 | 0.053 | 0.23 | 0.29 | 0.002 | 0.002 | 0.03 | 31.6 | — | 16.1 | — | 0.91 |
| 12 | 0.062 | 0.34 | 0.42 | 0.003 | 0.002 | 0.03 | 31.7 | — | 15.9 | — | 0.81 |
| 13 | 0.040 | 0.41 | 0.35 | 0.004 | 0.003 | 0.03 | 32.2 | 0.43 | 16.2 | — | 0.84 |
| 14 | 0.061 | 0.28 | 0.36 | 0.002 | 0.003 | 0.03 | 31.5 | — | 15.5 | 0.31 | 0.95 |
| 15 | 0.042 | 0.31 | 0.21 | 0.003 | 0.002 | 0.34 | 32.3 | — | 16.1 | — | 0.78 |
| Comparative alloy | | | | | | | | | | | |
| 1 | 0.046 | 0.21 | 0.33 | 0.003 | 0.003 | 0.04 | 31.8 | — | 21.7 | — | 0.82 |
| 2 | 0.051 | 0.32 | 0.25 | 0.004 | 0.002 | 0.03 | 32.2 | — | 15.9 | — | 0.85 |
| 3 | 0.060 | 0.26 | 0.41 | 0.002 | 0.003 | 0.03 | 31.5 | — | 16.2 | — | 0.79 |
| 4 | 0.049 | 0.25 | 0.26 | 0.004 | 0.003 | 0.04 | 32.5 | — | 16.0 | — | 0.62 |
| 5 | 0.042 | 0.32 | 0.30 | 0.003 | 0.003 | 0.02 | 31.7 | — | 16.3 | — | 1.41 |
| 6 | 0.041 | 0.21 | 0.19 | 0.003 | 0.002 | 0.03 | 59.8 | — | 18.4 | — | 0.91 |

| Alloy No. | Chemical composition (wt %) | | | | | | | M-value | Ti/Al (at %) | Al + Ti + Nb + Ta (at %) |
|---|---|---|---|---|---|---|---|---|---|---|
| | Al | Ti | B | Mg + Ca | O | N | Fe | | | |
| Invention alloy | | | | | | | | | | |
| 1 | 1.16 | 2.65 | 0.0046 | 0.0021 | 0.0011 | 0.0042 | Bal. | 0.939 | 1.29 | 5.89 |
| 2 | 1.41 | 2.83 | 0.0063 | 0.0041 | 0.0019 | 0.0031 | Bal. | 0.949 | 1.13 | 6.55 |
| 3 | 1.02 | 2.45 | 0.0038 | 0.0017 | 0.0014 | 0.0036 | Bal. | 0.931 | 1.35 | 5.38 |
| 4 | 1.14 | 2.61 | 0.0065 | 0.0032 | 0.0021 | 0.0041 | Bal. | 0.935 | 1.29 | 5.84 |
| 5 | 1.22 | 2.59 | 0.0021 | 0.0015 | 0.0019 | 0.0039 | Bal. | 0.939 | 1.20 | 6.09 |
| 6 | 1.18 | 2.71 | 0.0031 | 0.0032 | 0.0015 | 0.0039 | Bal. | 0.944 | 1.29 | 5.96 |
| 7 | 1.07 | 2.57 | 0.0054 | 0.0056 | 0.0021 | 0.0051 | Bal. | 0.944 | 1.35 | 5.51 |
| 8 | 0.98 | 2.30 | 0.0061 | 0.0018 | 0.0018 | 0.0035 | Bal. | 0.926 | 1.32 | 5.28 |
| 9 | 1.19 | 2.68 | 0.0043 | 0.0033 | 0.0018 | 0.0044 | Bal. | 0.931 | 1.27 | 6.02 |
| 10 | 1.23 | 2.54 | 0.0039 | 0.0041 | 0.0019 | 0.0045 | Bal. | 0.946 | 1.16 | 5.88 |
| 11 | 1.10 | 2.91 | 0.0063 | 0.0051 | 0.0021 | 0.0042 | Bal. | 0.945 | 1.49 | 6.13 |
| 12 | 1.39 | 2.47 | 0.0041 | 0.0053 | 0.0017 | 0.0051 | Bal. | 0.944 | 1.00 | 6.13 |
| 13 | 1.14 | 2.51 | 0.0040 | 0.0021 | 0.0022 | 0.0048 | Bal. | 0.939 | 1.24 | 5.72 |
| 14 | 1.09 | 2.63 | 0.0031 | 0.0043 | 0.0021 | 0.0047 | Bal. | 0.940 | 1.36 | 5.83 |
| 15 | 1.21 | 2.55 | 0.0045 | 0.0043 | 0.0019 | 0.0038 | Bal. | 0.941 | 1.19 | 5.86 |
| Comparative alloy | | | | | | | | | | |
| 1 | 1.26 | 2.61 | 0.0043 | 0.0032 | 0.0020 | 0.0039 | Bal. | 0.959 | 1.17 | 6.03 |
| 2 | 1.41 | 2.22 | 0.0044 | 0.0035 | 0.0019 | 0.0041 | Bal. | 0.940 | 0.89 | 5.92 |
| 3 | 0.81 | 2.91 | 0.0052 | 0.0029 | 0.0025 | 0.0039 | Bal. | 0.939 | 2.02 | 5.48 |
| 4 | 0.83 | 2.11 | 0.0042 | 0.0280 | 0.0016 | 0.0048 | Bal. | 0.923 | 1.43 | 4.50 |
| 5 | 1.46 | 2.92 | 0.0042 | 0.0026 | 0.0025 | 0.0056 | Bal. | 0.959 | 1.13 | 7.16 |
| 6 | 1.06 | 2.48 | 0.0029 | 0.0027 | 0.0020 | 0.0044 | Bal. | 0.907 | 1.32 | 5.63 |

High temperature-high speed tensile properties

By using a high temperature-high speed tensile tester, the tensile test was carried out using the aforementioned round bar specimen cut out from the ingot under an elastic stress rate of 50 mm/s at respective temperatures between 800° C. and 1200° C. in order to examine the hot workability of the respective alloys. A hot-workable temperature range was defined as a temperature range where reduction of area of not less than 60% can be obtained, which is required for the hot rolling, and the hot workability of the respective alloys was evaluated by obtaining the hot-workable temperature range for every alloy on basis of the results of the aforementioned high temperature-high speed tensile test.

Hardness

Hardness at a room temperature was measured by C-scale using the Rockwell hardness tester for respective alloys. High-temperature hardness was measured at 800° C. by applying testing load of 5 kg using the Vickers high-temperature hardness tester for the respective short time aging testing materials.

Impact value

An impact test piece having a 2 mm U-notch specified as No.3 test piece in JIS Z 2202 were cut from the respective testing materials, and the impact value was obtained by carring out the Charpy impact test at a room temperature.

Fatigue strength

An uniform gauge test piece with a parallel part of 8 mm in diameter was cut from the respective testing materials, and the rotary bending fatigue test was carried out at 800° C. using the Ono-type rotary bending fatigue testing machine. The fatigue strength was obtained as the maximum skin stress when the number of cycles reached $10^8$ times before failure.

Oxidation resistance

A test piece of 7 mm in diameter with a 15 mm length was cut from the respective ingots, and the oxidation resistance was evaluated by measuring an oxidation gain after heating at 850° C. for 400 hours in still air.

Obtained results by the aforementioned tests are shown in Table 2 in all.

TABLE 2

| | Short time aging | | | | Long time aging | | | | | |
|---|---|---|---|---|---|---|---|---|---|---|
| | Hardness | | | | Hardness | | | | Hot-workable | Oxication |
| Alloy No. | At room temperature (HRC) | At 800° C. (Hv) | Fatigue strength (MPa) | Impact value (J/cm2) | at room temperature (HRC) | Fatigue strength (MPa) | Impact value (J/cm2) | Remarks | temperature range (Hot workability) (°C.) | gain (oxidation resistance) |
| Invention alloy | | | | | | | | | | |
| 1 | 32.4 | 257 | 224 | 102 | 30.0 | 281 | 96.6 | | 289 | 1.24 |
| 2 | 31.8 | 283 | 341 | 90 | 32.1 | 223 | 87.0 | | 282 | 1.27 |
| 3 | 30.8 | 236 | 191 | 113 | 28.5 | 185 | 105.5 | | 303 | 1.18 |
| 4 | 32.4 | 255 | 221 | 103 | 29.9 | 215 | 97.4 | | 310 | 1.36 |
| 5 | 31.7 | 265 | 235 | 98 | 31.3 | 229 | 93.2 | | 256 | 1.25 |
| 6 | 32.5 | 259 | 225 | 101 | 29.8 | 219 | 95.5 | | 271 | 1.25 |
| 7 | 30.9 | 241 | 196 | 110 | 28.5 | 190 | 103.2 | | 313 | 1.15 |
| 8 | 30.3 | 232 | 192 | 115 | 29.2 | 186 | 107.5 | | 331 | 1.13 |
| 9 | 31.9 | 262 | 233 | 99 | 30.4 | 227 | 94.5 | | 281 | 1.40 |
| 10 | 30.8 | 256 | 210 | 102 | 31.1 | 208 | 96.8 | | 282 | 1.08 |
| 11 | 33.7 | 266 | 234 | 97 | 27.6 | 192 | 92.9 | | 296 | 1.35 |
| 12 | 30.1 | 260 | 225 | 97 | 32.1 | 229 | 92.8 | | 274 | 1.14 |
| 13 | 31.2 | 250 | 206 | 105 | 30.6 | 197 | 99.4 | | 290 | 1.16 |
| 14 | 32.1 | 254 | 208 | 103 | 28.3 | 196 | 97.6 | | 276 | 1.27 |
| 15 | 30.8 | 255 | 219 | 102 | 30.3 | 213 | 97.1 | | 289 | 1.18 |
| Comparative alloy | | | | | | | | | | |
| 1 | 31.0 | 262 | 239 | 99 | 39.1 | 183 | 15.0 | Precipitation of σ-phase | 280 | 0.91 |
| 2 | 24.6 | 192 | 165 | 139 | 28.9 | 171 | 96.1 | | 286 | 1.03 |
| 3 | 37.1 | 274 | 191 | 131 | 23.5 | 146 | 37.0 | Precipitation of η-phase | 313 | 1.37 |
| 4 | 24.4 | 186 | 148 | 151 | 23.4 | 139 | 121.0 | | 358 | 1.00 |
| 5 | — | — | — | — | — | — | — | | 198 | 1.32 |
| 6 | 35.6 | 281 | 226 | 109 | 28.9 | 215 | 108.0 | | 283 | 0.80 |

As is apparent from Table 2, the alloys according to this invention had the hot-workable temperature range wider than 250° C. similarly to the conventional alloy (comparative alloy No.6) containing high Ni. In the comparative alloy No.5 of which chemical compositions are within the ranges of this invention individually but of which total atomic percentage of the γ'-former elements Al, Ti, Nb and Ta exceeds 7.0%, the hot-workable temperature range was narrow (198° C.). In the comparative alloy No.5 having large M-value of 0.959, evaluation of the mechanical properties was not carried out since cracks were produced in the ingot.

Each of the invention alloys No.1 to No.15 had the room temperature hardness, the room temperature impact value and the fatigue strength equivalent to those of the comparative alloy No.6. Furthermore, the invention alloys had high-temperature hardness of higher than Hv 200 after the short time aging treatment and were sufficiently suitable for materials for the engine valve.

In the comparative alloy No.1, the σ-phase (embrittlement phase) was formed in the matrix by the heating for a long time and the hardness became higher in some degree, but the impact value was degreded remarkably after the long time heating since the respective amounts of the individual elements was in the range of this invention but the M-value exceeded 0.95.

The comparative alloy No.2 was not hardened sufficiently by the aging treatment at 750° C. for 4 hours and not so excellent in the hardness as low as HRC 24.6, and inferior to the invention alloys also in the fatigue strength since the atomic percentage ratio of Ti/Al was lower than 1.0. The comparative alloy No.3 was deteriorated in the room temperature hardness, the fatigue strength and especially in the room temperature impact value because the atomic percentage ratio of Ti/Al was higher than 1.5 and the η-phase was formed in a large quantity. In the comparative alloy No.4, the γ'-phase was not precipitated sufficiently since the total atomic percentage of Al, Ti, Nb and Ta was lower than 5%, and the fatigue strength was low as compared the invention alloys.

Experiment 2

The invention alloy No.2 shown in Table 1 was formed into bar metal of 6.1 mm in diameter through rolling and drawing. The obtained bar metal was subjected to upsetting after heating one end thereof by passing an electric current in the bar metal directly, and a valve head was forged through stamp forging. The valve head was joined with a valve stem made of martensitic heat resisting steel (SUH11 specified in JIS G 4311) through friction welding, and an exhaust valve was produced by machining after heat treatment.

Furthermore, the invention alloy No.2 was formed into a fine wire of 0.25 mm in diameter through rolling and wire drawing. Subsequently, the wire was formed into a knit mesh for retaining honeycomb ceramics of catalyzer to purify exhaust gas.

The obtained exhaust valve and knit mesh were assembled respectively into an engine for an endurance test using nonleaded gasoline and an exhaust gas treatment equipment in the engine, and the endurance test was carried out for 400 hours. The endurance test was possible to be completed without any trouble. As a result of investigating the extent of damage of the exhaust valve and the knit mesh such as a appearance change, a state of corrosion and so on after the endurance test, it was confirmed that the extent of damage of the valve and the knit mesh made of the alloy according to this invention was equivalent to that of the valve and the knit mesh made of the conventional high Ni alloy (comparative alloy No.6), and the heat resisting alloy according to this invention had excellent high temperature properties as a material for the exhaust valve and the knit mesh for retaining the catalyzer.

As mentioned above, according to this invention, it is possible to provide the heat resisting alloy of Fe—Cr—Ni type which is cheapened by reducing the Ni content down to 30 to 35%, is excellent in the strength equivalently to the alloy containing Ni of 50% or more, has the excellent structural stability such that the harmful η-phase are never precipitated even by the application for a long time, is excellent in the hot workability, and has the sufficient oxidation resistance. Whereby, it is possible to provide the exhaust valve for the automotive engine and the knit mesh for the catalyzer purifying exhaust gas which are economical and excellent in the high temperature properties.

What is claimed is:

1. A heat resisting alloy of Fe—Cr—Ni consisting by weight percentage of 0.01 to 0.10% of C, not more than 2% of Si, not more than 2% of Mn, 14 to 18% of Cr, 0.5 to 1.5% in total of Nb and Ta, 2.0 to 3.0% of Ti, 0.8 to 1.5% of Al, 30 to 34.9% of Ni, 0.001 to 0.01% of B, 0.001 to 0.01% in total of Ca and Mg, not more than 0.5% of Cu, not more than 0.02% of P, not more than 0.01% of S, not more than 0.01% of O, not more than 0.01% of N, and the balance being Fe and inevitable impurities, wherein the total atomic percentage of Al, Ti, Nb and Ta is in a range of 5.0 to 7.0%, an atomic percentage ratio of Ti/Al is in a range of 1.0 to 1.5, and M-value calculated using the following equation does not exceed 0.95;

$$M=(0.717\ Ni(\text{atomic percentage})+0.858\ Fe(\text{atomic percentage})+1.142\ Cr(\text{atomic percentage})+1.90\ Al(\text{atomic percentage})+2.271\ Ti(\text{atomic percentage})+2.117\ Nb(\text{atomic percentage})+2.224\ Ta(\text{atomic percentage})+1.001\ Mn(\text{atomic percentage})+1.90\ Si(\text{atomic percentage}))/100.$$

2. A heat resisting alloy of Fe—Cr—Ni according to claim 1, wherein said alloy further contains not more than 0.5% in total of W and Mo.

3. A heat resisting alloy of Fe—Cr—Ni according to claim 1, wherein said alloy further contains not more than 5.0% of Co with the proviso that the total of Ni and Co is in a range of 30 to 35%.

4. A heat resisting alloy of Fe—Cr—Ni according to claim 2, wherein said alloy further contains not more than 5.0% of Co with the proviso that the total of Ni and Co is in a range of 30 to 35%.

5. A heat resisting alloy of Fe—Cr—Ni according to claim 1, wherein high-temperature hardness at 800° C. is not lower than 200 of Vickers hardness.

6. A heat resisting alloy of Fe—Cr—Ni according to claim 2, wherein high-temperature hardness at 800° C. is not lower than 200 of Vickers hardness.

7. A heat resisting alloy of Fe—Cr—Ni according to claim 3, wherein high-temperature hardness at 800° C. is not lower than 200 of Vickers hardness.

8. A heat resisting alloy of Fe—Cr—Ni according to claim 4, wherein high-temperature hardness at 800° C. is not lower than 200 of Vickers hardness.

9. A heat resisting alloy of Fe—Cr—Ni according to claim 1, wherein 2 mm U-notch Charpy impact value at a room temperature after heating at 800° C. for 400 hours in not lower than 50 J/cm$^2$.

10. A heat resisting alloy of Fe—Cr—Ni according to claim 2, wherein 2 mm U-notch Charpy impact value at a room temperature after heating at 800° C. for 400 hours in not lower than 50 J/cm$^2$.

11. A heat resisting alloy of Fe—Cr—Ni according to claim 3, wherein 2 mm U-notch Charpy impact value at a room temperature after heating at 800° C. for 400 hours in not lower than 50 J/cm$^2$.

12. A heat resisting alloy of Fe—Cr—Ni according to claim 4, wherein 2 mm U-notch Charpy impact value at a room temperature after heating at 800° C. for 400 hours in not lower than 50 J/cm$^2$.

13. A heat resisting alloy of Fe—Cr—Ni according to claim 1, wherein high-temperature rotary bending fatigue strength of $10^8$ times at 800° C. after heating at 800° C. for 400 hours is not lower than 147 MPa.

14. A heat resisting alloy of Fe—Cr—Ni according to claim 2, wherein high-temperature rotary bending fatigue strength of $10^8$ times at 800° C. after heating at 800° C. for 400 hours is not lower than 147 MPa.

15. A heat resisting alloy of Fe—Cr—Ni according to claim 3, wherein high-temperature rotary bending fatigue strength of $10^8$ times at 800° C. after heating at 800° C. for 400 hours is not lower than 147 MPa.

16. A heat resisting alloy of Fe—Cr—Ni according to claim 4, wherein high-temperature rotary bending fatigue strength of $10^8$ times at 800° C. after heating at 800° C. for 400 hours is not lower than 147 MPa.

17. An exhaust valve for an automotive engine made of the heat resisting alloy according to any one of claims 1 to 16.

18. A knit mesh for a catalyzer purifying exhaust gas of an automotive engine made of the heat resisting alloy according to any one of claims 1 to 16.

* * * * *